United States Patent [19]

Müller

[11] 4,133,521

[45] Jan. 9, 1979

[54] SHEET MATERIAL COLLATING APPARATUS

[75] Inventor: Hans Müller, Zofingen, Switzerland

[73] Assignee: GRAPHA-Holding AG., Hergiswil, Switzerland

[21] Appl. No.: 764,640

[22] Filed: Feb. 1, 1977

[30] Foreign Application Priority Data

Feb. 19, 1976 [CH] Switzerland ..... 2023/76

[51] Int. Cl.[2] ..... B65H 5/30

[52] U.S. Cl. ..... 270/55

[58] Field of Search ..... 270/55, 57

[56] References Cited

U.S. PATENT DOCUMENTS

| | | | |
|---|---|---|---|
| 336,878 | 2/1886 | Wood | 270/54 |
| 1,951,300 | 3/1934 | Zimmer | 270/55 |
| 2,461,573 | 2/1949 | Schweizer | 270/55 |
| 2,634,971 | 4/1953 | Schweizer | 270/55 |
| 3,450,400 | 6/1969 | Guggisberg | 270/55 |

FOREIGN PATENT DOCUMENTS

| | | | |
|---|---|---|---|
| 1436585 | 10/1968 | Fed. Rep. of Germany | 270/57 |

*Primary Examiner*—Edgar S. Burr
*Assistant Examiner*—A. Heinz
*Attorney, Agent, or Firm*—Peter K. Kontler

[57] ABSTRACT

A newspaper stuffing apparatus wherein pockets which serve for reception of newspaper jackets and inner sections are transported along an endless path past a first feeder which admits openable jackets, past at least one second feeder which admits inner sections into opened jackets in successive pockets, and thereupon past an evacuating device which removes the thus assembled newspapers from successive pockets. Each pocket is associated with a retaining blade which is held at one end of the pocket during travel past the first feeder, which is moved by a spring into the pocket and clamps one-half of the opened jacket against one wall of the pocket during travel toward and past the second feeder, and which is retracted from the pocket not later than when the pocket reaches the evacuating device. Each blade is reciprocable along and is held against rotation relative to a guide shaft which is located behind the one wall of the respective pocket and can be rotated to move the blade against or away from one-half of the opened jacket in the respective pocket.

19 Claims, 5 Drawing Figures

SHEET MATERIAL COLLATING APPARATUS

BACKGROUND OF THE INVENTION

The present invention relates to improvements in apparatus for collating sheet material articles, especially to newspaper stuffing apparatus wherein folded outer sections or jackets of newspapers are assembled with inner sections in openable pockets which are transported along an endless path. In such apparatus, the sections are furnished by a series of hoppers or analogous feeding devices which are adjacent the path for the pockets. Each jacket is caused to open before the respective pocket reaches a feeding device for inner sections so that the inner section or sections can be introduced into the opened jacket.

Heretofore known newspaper stuffing and analogous apparatus exhibit the drawback that the jackets are not invariably held in open positions during transport past the feeding devices for inner sections and that the jackets are likely to shift in their pockets prior to introduction of inner sections. This can interfere with automatic assembly of newspapers and/or with the operation of devices which evacuate and/or stack the newspapers. Furthermore, presently known stuffing apparatus do not have any reliable means for insuring that each of the jackets is opened up in the same way, i.e., that the inner sections are introduced between preselected sheets of the respective jackets. As a rule, it is desirable to open each jacket in the middle, i.e., to introduce one or more inner sections between the two halves of a folded but partially opened jacket.

OBJECTS AND SUMMARY OF THE INVENTION

An object of the invention is to provide a newspaper stuffing or an analogous apparatus with novel and improved pockets which insure that each jacket is opened up in the same way, and to provide the apparatus with novel and improved means which insures that the jackets remain open during introduction of one or more inner sections.

Another object of the invention is to provide novel and improved means for temporarily retaining and clamping portions of opened jackets to the respective pockets of a newspaper stuffing or analogous apparatus.

A further object of the invention is to provide novel and improved means for moving and locking the retaining means during predetermined stages of movement of the respective pockets along an endless path.

An additional object of the invention is to provide the apparatus with novel and improved means for moving the walls of successive pockets relative to each other so as to insure convenient introduction of jackets and inner sections as well as reliable retention of such articles in the pockets during transport toward the evacuating station or stations.

Still another object of the invention is to provide the apparatus with novel and improved means for mounting the walls and other component parts of the pockets.

The invention is embodied in an apparatus for collating and otherwise manipulating sheet material articles including openable jackets and inserts or inner sections for such jackets, particularly in a newspaper stuffing apparatus. The apparatus comprises a plurality of pockets each having a first and a second wall (the second wall is preferably pivotable with respect to the first wall), one or more chain conveyors or analogous means for transporting the pockets along an endless path (preferably an oval path which is disposed in a horizontal or nearly horizontal plane), at least one stuffer including a first device for feeding jackets between the walls of successive pockets in a first portion of the path and at least one second device for feeding inserts into opened jackets in successive pockets in a second portion of the path, means for evacuating assembled jackets and inserts from successive pockets in a third portion of the path, at least one blade- or sword-like retaining and clamping device for each pocket, springs or other suitable means for introducing the retaining devices between the walls of successive pockets and into opened jackets in such pockets intermediate the first and second portions of the path, springs or other suitable means for moving the inserted retaining devices toward one of the respective walls (preferably toward the first wall) to thereby clamp a portion (preferably one-half) of the opened jacket against the one wall of the respective pocket during transport of pockets past the second feeding device, and cam and follower means or analogous means for removing the retaining devices from the respective pockets not later than in the third portion of the path so that the assembled articles can be readily evacuated from their pockets. The apparatus preferably further comprises means (e.g., additional cam and follower means) for moving each retaining device away from the one wall of the respective pocket (to thus release the clamped portion of the jacket in such pocket) prior to removal of the retaining devices from their pockets.

The pockets preferably extend transversely of the direction of movement along the endless path, and the apparatus preferably further comprises guide means for each retaining device. Each such guide means may include an elongated shaft which extends transversely of the direction of transport of the pockets. The introducing means (e.g., the aforementioned springs) can move the retaining devices in one direction lengthwise of the respective guide means, and the removing means can move the retaining devices lengthwise of the respective guide means but in the opposite direction.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
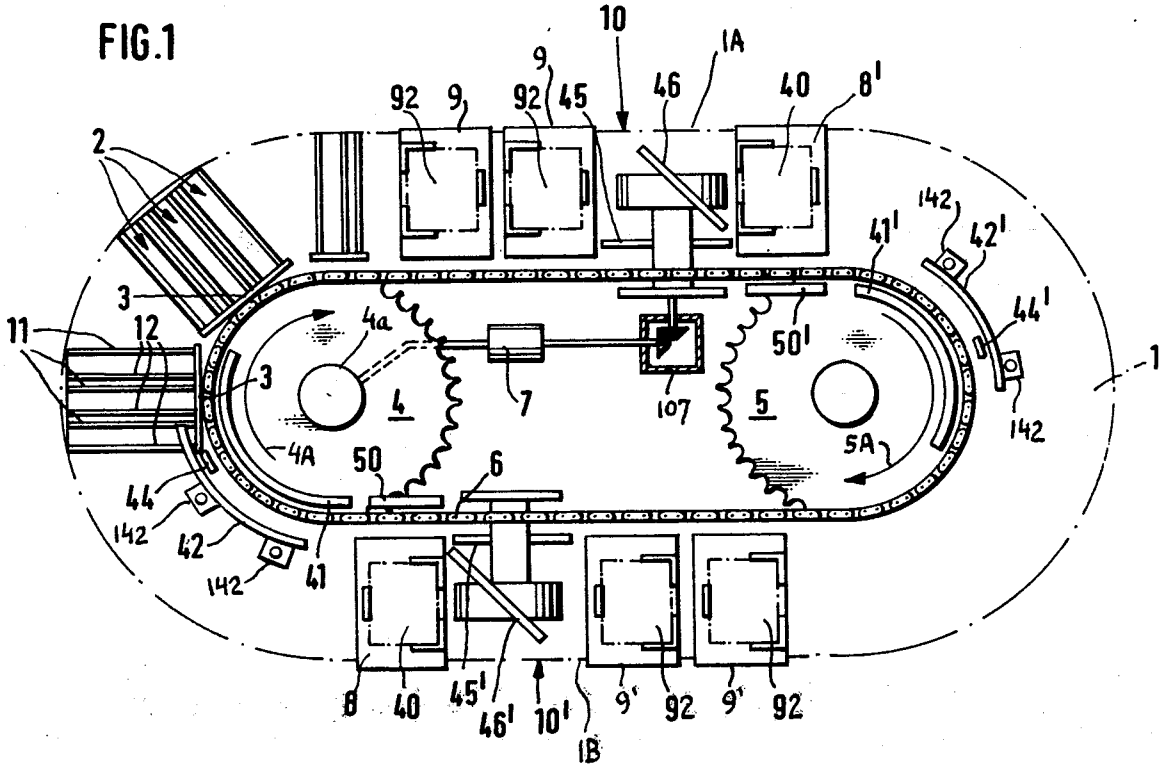
FIG. 1 is a diagrammatic plan view of an apparatus which embodies the invention and wherein each pocket assembles and is relieved of two complete newspapers during each travel along an endless path.

Referring first to FIG. 1, there are shown certain parts of a sheet material collating apparatus which can be used for stuffing of newspapers and whose operation is somewhat similar to that of apparatus which are disclosed in U.S. Pat. Nos. 3,874,649 and 3,881,716 to Bryson et al. The apparatus comprises a chain conveyor having an endless link chain 6 trained over two sprocket wheels 4 and 5 and defining an endless oval path 1 for a large number of equally spaced substantially V-shaped pockets 2. The endless path 1 is located in a horizontal plane and includes two elongated straight stretches 1A, 1B which are parallel to each other. the pockets 2 form several groups of three pockets each, and each such group of pockets is mounted on a plate-like carrier 3 which is secured to or made integral with the adjacent link of the chain 6. The vertical shaft **4*a* for the sprocket wheel 4 receives torque from a main prime mover 7 (e.g., a variable-speed electric motor) which preferably transmits motion to some or all other mobile components of the apparatus. FIG. 1 shows a bevel gear transmission 107 which is driven by the output element of the prime mover 7 and can transmit motion to one or more mobile components. The directions in which the sprocket wheels 4 and 5 rotate when the prime mover 7 is on are indicated by arrows 4A and 5A**.

In addition to the pockets 2 and transporting means 3–6 therefor, the apparatus further comprises two stuffers and two preferably automatic removing or evacuating units 10 and 10' for fully assembled newspapers. The evacuating unit 10 is installed at a level below the straight stretch 1A and the evacuating unit 10' is installed at a level below the straight stretch 1B of the endless path 1 for the pockets 2. Evacuating units which can be used in the apparatus of the present invention are disclosed in my commonly owned copending application Ser. No. 764,631 filed Feb. 1, 1977 for "Apparatus for stuffing newspapers or the like".

Figure 3:
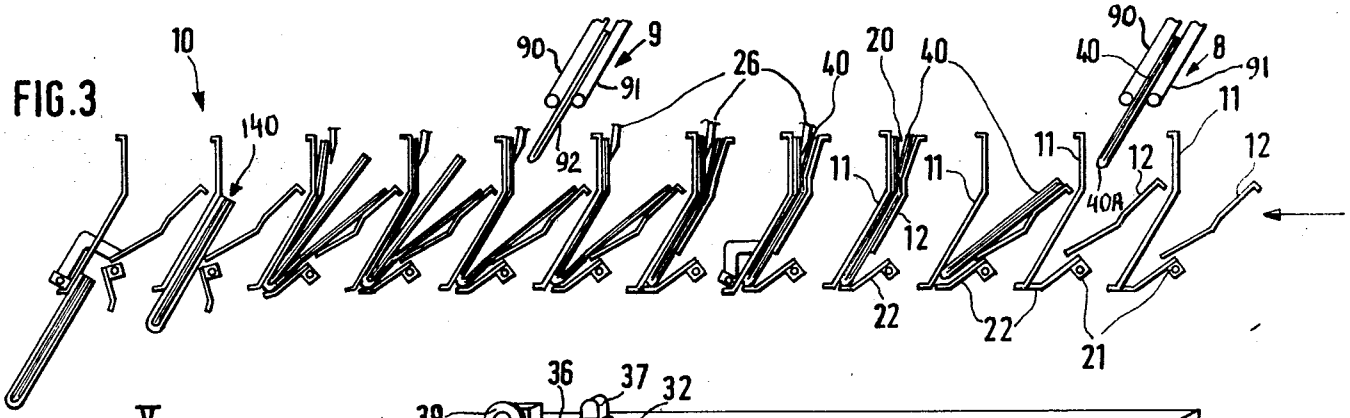
FIG. 3 is a schematic elevational view of a series of pockets, showing the manner in which a complete newspaper is assembled therein during transport along the feeding devices of one of the two stuffers shown in FIG. 1.

The first stuffer comprises a primary feeding device 8 (hereinafter called feeder) for freshly printed jackets 40 of newspapers and one or more (e.g., two) additional or secondary feeders 9 serving to store and to feed inserts or inner sections 92 (e.g., preprinted sheets or groups of sheets) which are to be inserted into the oncoming jackets 40 to thus convert the jackets and the associated inserts into fully assembled newspapers 140 (FIG. 3). The primary feeder 8 is located above the straight stretch 1B and the secondary feeders 9 are located above the straight stretch 1A. The second stuffer comprises a primary feeder 8' mounted at a level above the stretch 1A and one or more (e.g., two) additional or secondary feeders 9' mounted at a level above the stretch 1B. The feeder 8' supplies jackets 40, and the feeders 9' supply inserts or inner sections 92. The newspapers 140 are assembled or collated in the pockets 2, and each assembled newspaper 140 is removed from the oncoming pocket 2 by the evacuating unit 10 or 10'. The evacuating units which are described and claimed in the aforementioned copending application Ser. No. 764,631 are designed to remove the contents of oncoming pockets 2 at a speed which can greatly exceed the speed of evacuation of such contents by gravity alone.

Empty pockets 2 which advance beyond the evacuating unit 10' receive jackets 40 from the primary feeder 8 and thereupon travel around the sprocket wheel 4 prior to receiving inserts 92 from the feeders 9. The thus assembled newspapers 140 are removed from successive pockets 2 by the evacuating unit 10, and each empty pocket 2 which advances beyond the evacuating unit 10 receives a jacket 40 from the primary feeder 8'. Such pockets thereupon travel around the sprocket wheel 5 prior to receiving inserts 92 from the secondary feeders 9'. The assembled newspapers 140 are removed by the evacuating unit 10' and each empty pocket 2 is then ready to receive a jacket 40 from the primary feeder 8 of the first stuffer.

The jackets 40 and the inserts 92 can descend into the pockets 2 therebelow by gravity, and each jacket 40 descends in such a way that its folded edge or back 40A (see FIGS. 3, 4 and 5) enters into the lowermost or deepmost portion of the respective pocket. Feeders which can be used in the apparatus of the present invention are disclosed, for example, in commonly owned British Pat. No. 901,816 or in Swiss Pat. No. 374,968. The evacuating units 10 and 10' deposit or otherwise transfer successive newspapers 140 onto a single conveyor system or onto two discrete conveyor systems for transport to a further processing station, e.g., to a stacker (not shown).

Figure 4:
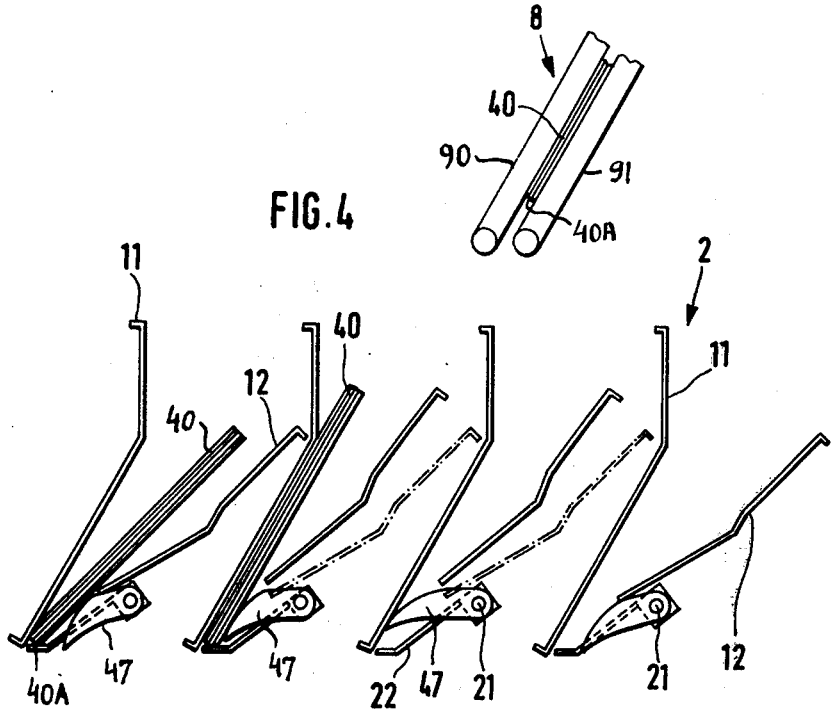
FIG. 4 is an enlarged view of a detail in FIG. 3.

As shown in FIGS. 3 and 4, each of the feeders 8, 9, 8', 9' may comprise two endless belt conveyors 90, 91 which can advance successive jackets 40 or inserts 92 at a speed slightly or greatly exceeding the speed at which the articles 40, 92 would advance under the action of gravity alone. At an elevated speed of the conveyors 90, 91, and in the absence of any remedial action, the articles 40, 92 would rebound on entry into the pockets 2 (jackets 40) or into the jackets (inserts 92).

Figure 2:
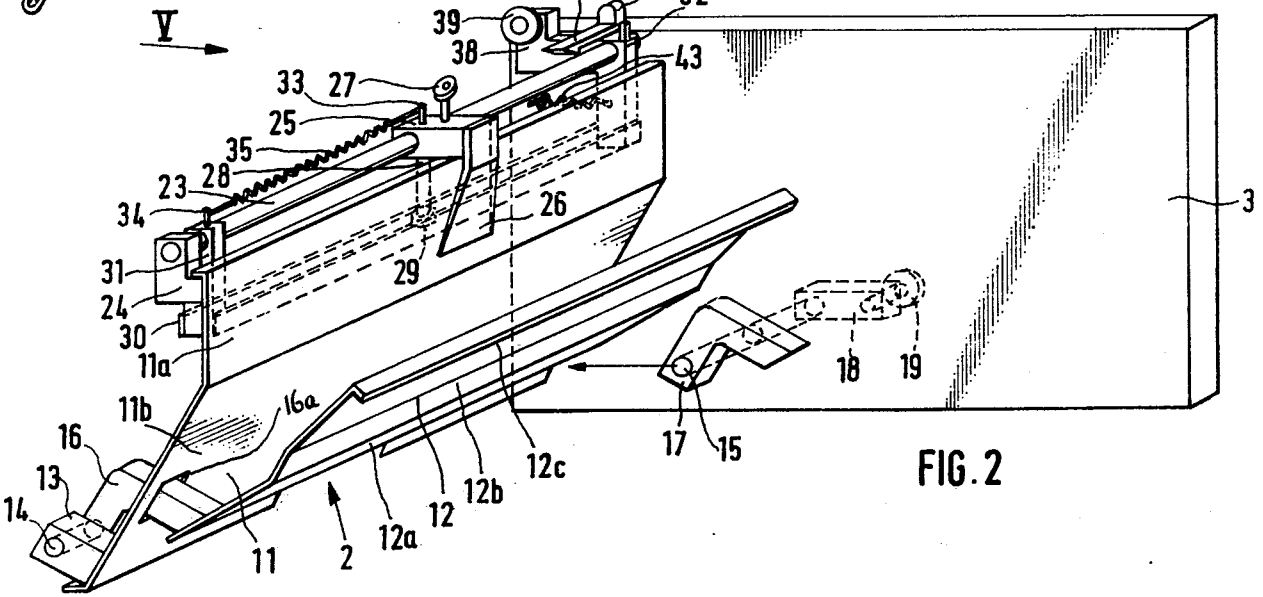
FIG. 2 is an enlarged perspective view of one of the pockets in the apparatus of FIG. 1.

FIG. 2 illustrates certain details of one of the pockets 2 and the corresponding plate-like carrier 3. As mentioned above, each carrier 3 supports a group of three identical pockets 2; however, two pockets of that group which includes the pocket 2 of FIG. 2 have been omitted for the sake of clarity. The illustrated pocket 2 comprises a stationary first wall 11 which is fixedly secured to the carrier 3 and a movable second wall 12. The first wall 11 includes a substantially vertical upper section or panel **11*a* and a lower section or panel 11*b* which is inclined relative to and makes an obtuse angle with the upper panel 11*a*. The outer side of the lower panel 11*b* (i.e., that side which faces away from the inner side of the movable second panel 12) carries a bearing 13 for a stub shaft 14 which is rigid or integral with an L-shaped lever 16 constituting a first support for the second wall 12. The stub shaft 14 is coaxial with a second shaft 15 (shown out of position in FIG. 2) which is rotatably mounted in the carrier 3 and is rigid or integral with a second L-shaped lever 17 constituting a second support for the movable second wall 12. The levers 16 and 17 are disposed at the opposite ends of the first wall 11 and each thereof extends through a suitably configurated opening or cutout in the panel 11*b* (FIG. 2 shows the opening 16*a* for the lever 16). That end portion of the shaft 15 which extends rearwardly beyond the carrier 3 is rigid with a lever 18 for a roller follower 19. The roller follower 19 tracks a stationary cam 41 or 41' (both shown in FIG. 1) during certain stages of movement of the pocket 2 along the endless path 1 whereby the roller follower 19 causes the wall 12 to pivot relative to the wall 11 about the common axis of the shafts 14 and 15 at intervals which are determined by the length and configuration of the cams 41 and 41'. The lever 18 may be biased clockwise, as viewed in FIG. 2, by one or more springs (not shown), or the roller follower 19 can engage the cam 41 or 41' owing to the weight of the second wall 12 and of newspaper sections in the pocket 2 so that the wall 12 pivots anticlockwise, as viewed in FIG. 2, toward the adjacent inner side of the first wall 11 when the roller follower 19 engages the upper side of the cam 41 or 41'. It is assumed that the second wall 12 tends to remain in the fully open position of FIG. 2 by gravity, i.e., that the second wall 12 assumes the illustrated position as soon as the roller follower 19 advances beyond the cam 41 or 41'**.

The second wall 12 comprises three sections or panels 12*a*, 12*b* and 12*c*. The lowermost and median panels 12*a*, 12*b* of the wall 12 make an obtuse angle which is identical with or closely approximates the obtuse angle between the panels 11*a*, 11*b* of the first wall 11. The uppermost panel 12*c* of the second wall 12 is disposed in a plane which is substantially parallel to the plane of the lowermost panel 12*a*. When the second wall 12 is pivoted toward or against the first wall 11, the panels 11*a* and 12*c* define a wedge-like compartment 20 (see FIG. 3) whose width increases upwardly, as viewed in FIG. 2 or 3. The compartment 20 is adjacent the upper edges of the walls 11, 12 and the pivot axis for the wall 12 is adjacent the lower edges of the walls 11, 12.

Figure 5:
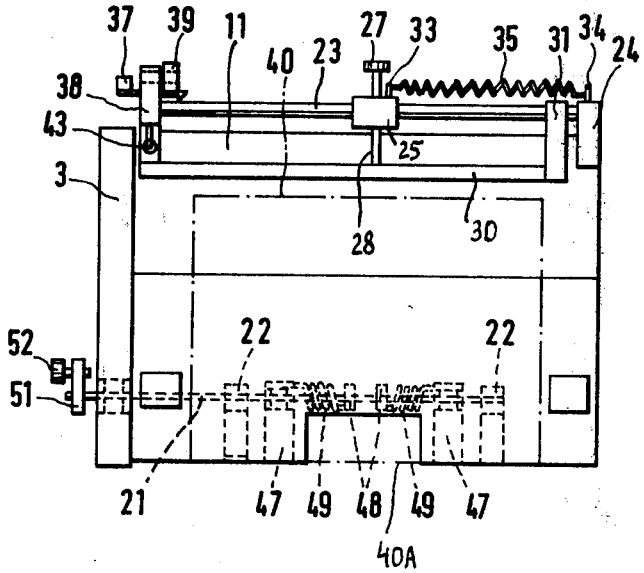
FIG. 5 is a smaller-scale rear elevational view of the pocket which is shown in FIG. 2, as seen in the direction indicated by arrow V.

The carrier 3 also supports a turnable supporting shaft 21 (see FIGS. 3 to 5) for each pocket 2 thereon. The shafts 21 are parallel to the respective pairs of coaxial shafts 14, 15 and each thereof supports two spaced-apart intercepting levers 22 having lower end portions which are bent toward the respective first walls 11 (see particularly FIGS. 3 and 4). Each shaft 21 is rigid with the respective levers 22 and its left-hand end portion, as viewed in FIG. 5, is rigid with a lever 51 for a roller follower 52 which tracks, at times, the periphery of a stationary cam 45 or 45' (shown in FIG. 1) secured to the frame of the stuffing apparatus. The configuration of the upper sides of the cams 45 and 45' is such that the roller followers 52 cause the associated levers 51 to pivot the corresponding shafts 21 (together with the associated pairs of intercepting levers 22) from first to second positions in which the levers 22 respectively extend close to (or actually contact) and are remote from the corresponding first walls 11. In their first or operative positions, the intercepting levers 22 insure that a jacket 40 or a newspaper 140 which is located in the respective pocket 2 cannot escape by sliding downwardly through the gap between the walls 11 and 12. In the second positions, the levers 22 allow the evacuating unit 10 or 10' to remove an assembled newspaper 140 from the respective pocket 2. The cams 45 and 45' respectively move the intercepting levers 22 away from the corresponding first walls 11 when the respective pockets 2 travel past (above) the evacuating stations occupied by the units 10 and 10'. During the major part of movement of each pocket 2 along the endless path 1, the corresponding intercepting levers 22 remain in the operative positions shown in FIG. 4.

FIG. 5 shows that each shaft 21 carries two retainers 48 which cannot rotate thereon and are located substantially midway between the intercepting levers 22. Each shaft 21 further carries two rotatable braking members 47 which resemble pawls (see particularly FIG. 4) and are biased by prestressed torsion springs 49. Each torsion spring 49 has a first end portion which is anchored in the adjacent retainer 48 and a second end portion anchored in the adjacent braking member 47 so that it tends to turn the braking member in a clockwise direction, as viewed in FIG. 4, namely toward the lower panel 11*b* of the respective first wall 11 and into engagement with the outer side of the respective second wall 12. When a braking member 47 abuts the adjacent second wall 12, a portion thereof extends beyond the lower edge of the panel 12*a*, beyond the inner side of the wall 12 and toward the corresponding first wall 11.

FIG. 1 shows two relatively short straight stationary cams 50 and 50' which are tracked by the roller followers 19 of successive levers 18. When a roller follower 19 engages the upper side of the cam 50 or 50' (it will be noted that the cams 50 and 50' are located immediately ahead of the cams 41, 41', as considered in the direction of travel of pockets 2 along the endless path 1), the corresponding second wall 12 is pivoted toward the associated first wall 11 to such an extent (see FIG. 4) that the braking members 47 can reach or come very close to the lower panel 11*b* of the first wall 11. Thus, when the conveyors 90, 91 of the primary feeder 8 or 8' propel a jacket 40 toward and into the space between the walls 11, 12 of the oncoming pocket 2, the members 47 frictionally engage and brake such jacket so that the latter comes to a full stop in a predetermined position with respect to the walls 11 and 12. The braking members 47 can yield since they are biased by the torsion springs 49, and they prevent any rebounding of jackets 40 on entry into the deepmost portions of the respective pockets 2. In the absence of braking members 47, the jackets 40 could (and normally would) rebound on impact against the corresponding intercepting levers 22, especially if the conveyors 90, 91 of the feeder 8 or 8' are driven at a high speed. It has been found that the provision of braking members 47 contributes to a reduction of the number of improperly assembled newspapers, especially as regards the reduction of likelihood of misalignment or false orientation of jackets 40. The braking members 47 are disclosed in my commonly owned copending application Ser. No. 764,638 filed Feb 1, 1977 for "Apparatus for forming sheet material assemblages".

The two discrete retainers 48 for the torsion springs 49 can be replaced with a single retainer. The braking members 47 are effective during those stages of transport of pockets 2 along the endless path 1 when the pockets travel below the primary feeders 8 and 8' (see the positions of cams 50 and 50' in FIG. 1), i.e., when the pockets travel below the feeders which admit jackets 40. When held in the operative positions shown in FIG. 4, the braking members 47 extend beyond the lower edge of the respective second wall 12, beyond the inner side of such second wall, and into engagement with a jacket 40. The lower panel 11*b* of the first wall 11 extends downwardly beyond the lowermost panel 12*a* of the associated second wall 12. Each braking member 47 normally abuts against the corresponding second wall 12; therefore, the braking members move away from the first wall 11 or from the jacket 40 on the corresponding intercepting levers 22 when the second wall 12 is caused to pivot away from the first wall 11. In other words, the braking members 47 move nearer to the first wall 11 in response to pivoting of the second wall 12 toward the wall 11 and vice versa.

Referring again to FIG. 2, the carrier 3 supports elongated guide shafts 23, one for each pocket 2. One end of the guide shaft 23 which is shown in FIG. 2 is journalled in the carrier 3 and its other end extends into a bearing 24 at the outer side of the upper panel 11*a* of the first wall 11. The shaft 23 serves as a guide for a block-shaped holder 25 which carries a downwardly extending retaining and clamping blade or sword 26. The holder 25 further carries an upwardly extending roller follower 27 and a downwardly extending post 28 for a roller follower 29 received in an elongated guide channel 30 having a U-shaped cross-sectional outline. The channel 30 is fixedly secured to the guide shaft 23 by means of two upwardly extending columns or beams 31, 32 having a polygonal outline. A helical spring 35 is connected to pins 33, 34 which are respectively secured to the holder 25 and column 31; the spring 35 tends to pull the blade 26 toward that end of the pocket 2 which is remote from the carrier 3, i.e., to introduce the blade into the pocket.

The column 32 supports a pivotable locking pawl 36 whose pallet can engage and retain the holder 25 for the blade 26, provided that the holder is moved close to the carrier 3, i.e., that the blade 26 is removed from the pocket. The pawl 36 has an upstanding lobe 37 which can be depressed to disengage the pawl from the holder 25 whereby the holder moves under the action of the spring 35 to advance the blade 26 into the pocket and to a central position (midway or substantially midway between the columns 31 and 32) which is shown in FIG. 2.

The guide shaft 23 is rigid with an L-shaped lever 38 for a roller follower 39. When the roller follower 39 is caused to move downwardly, as viewed in FIG. 2, the channel 30 is moved against the outer side of the first wall 11 and the blade 26 is moved away from the inner or front side of the wall 11.

When a pocket 2 travels below the primary feeder 8 of the first stuffer (see FIGS. 3 and 4), the blade 26 is close to the respective carrier 3, i.e., the pallet of the locking pawl 36 engages the holder 25 and maintains the blade 26 at one end of the pocket and out of the path of downward movement of a jacket 40. Furthermore, the roller follower 19 allows the second wall 12 of such pocket to assume the open position of FIG. 2 while the lower or free end portions of the corresponding intercepting levers 22 engage or are close to the first wall 11 (this is shown in the right-hand portion of FIG. 3 and in FIG. 4). The conveyors 90 and 91 of the feeder 8 propel a jacket 40 whose folded edge or back 40A enters the pocket 2 therebelow ahead of the remaining portion of such jacket (see particularly FIG. 4), and the folded edge 40A comes to rest on the levers 22.

During travel of a pocket 2 below the feeder 8, the corresponding roller follower 19 engages the cam 50. This entails a movement of the second wall 12 from the fully open position (shown in the rightmost portion of FIG. 4) to the partly open position (shown by solid lines in the middle of FIG. 4). Consequently, the braking members 47 can move closer to the first wall 11 and frictionally engage the descending jacket 40 with a force which does not suffice to prevent the folded edge 40A of the jacket from reaching the intercepting levers 22 but is sufficient to prevent any rebounding of the jacket 40 in response to impact of its folded edge against the levers 22. The levers 22 are held in the operative positions of FIG. 4 while the roller follower 19 tracks the cam 50, i.e., the levers 22 extend across the gap between the lowermost panel **12*a* of the second wall 12 and the lower panel 11*b* of the first wall 11 and automatically intercept and hold the introduced jacket 40 in a predetermined position with respect to the walls 11, 12 and the associated carrier 3. The retention of the jacket 40 in such predetermined position is insured by the braking members 47 which prevent the jacket from rebounding in response to descent into engagement with the levers 22**.

The conveyor chain 6 continues to transport the partially filled pocket 2 along the endless path 1 whereby the roller follower 19 engages the stationary cam 41 (this cam may constitute an elongated arcuate rail). The second cam 41' is mounted downstream of the primary feeder 8' of the second stuffer. The cam 41 causes the second wall 12 to pivot toward the first wall 11, i.e., the jacket 40 whose folded edge 40A rests on the intercepting levers 22 is clamped between the walls 11 and 12 (see FIG. 3). As mentioned above, the uppermost panel **12*c* of the second wall 12 and the upper panel 11*a* of the first wall 11 define a wedge-like compartment 20 when the lowermost and median panels 12*a*, 12*b* of the second wall 12 are adjacent the wall 11; the compartment 20 enables the upper portion of the jacket 40 in the pocket 2 to open up (see FIG. 3) so as to provide room for introduction of the retaining blade 26 by the spring 35**.

The chain 6 continues to move the pocket 2 along the endless path 1 whereby the roller follower 39 of the lever 38 reaches and is engaged by the fixed (but preferably adjustably mounted) cam 42 which is shown in FIG. 1 and may constitute an elongated rail. The cam 42 causes the shaft 23 to rotate anticlockwise, as viewed in FIG. 2, against the opposition of a spring 43 which is attached to the column 32. The blade 26 is thereby moved away from the upper panel **11*a* of the first wall 11. The level of the cam 42 in the frame of the stuffing apparatus is preferably selected in such a way that the blade 26 is pivoted to a position substantially midway betweeen the panels 11*a*, 12*c* of the pocket 2, i.e., substantially into the central longitudinal symmetry plane of the compartment 20. This insures that the blade 26 is then disposed in register with the gap between the halves of the partly opened-up jacket 40 in the pocket 2. A second adjustable cam 42' is mounted downstream of the primary feeder 8' of the second stuffer. The means for adjusting the levels of cams 42, 42' comprises bolts and nuts 142** or other suitable devices which can move the cams up or down.

The pocket 2 continues to move along the path 1 and the lobe 37 of the locking pawl 36 strikes against and is pivoted by a stationary cam 44 (shown in FIG. 1) which automatically disengages the pallet of the pawl 36 from the holder 25 whereby the latter moves along the shaft 23 and away from the carrier 3 under the action of the spring 35. This introduces the blade 26 into the gap between the halves of the jacket 40 in the pocket 2. Shortly or immediately thereafter, the roller follower 39 moves beyond the adjustable cam 42 so that the spring 43 is free to contract and to turn the shaft 23 clockwise, as viewed in FIG. 2, in order to move the blade 26 against that half of the jacket 40 which lies against the inner side of the upper panel **11*a* of the first wall 11**.

During the next-following stage of movement of the pocket 2, the roller follower 19 moves beyond the cam 41 so that the wall 12 is free to pivot to the open position of FIG. 2. This enables one-half of the jacket 40 in the pocket 2 to follow the pivotal movement of the second wall 12, i.e., the jacket opens up all the way to its folded edge 40A which rests on the intercepting levers 22. Such full opening of the jacket 40 is desirable and advantageous because it allows for introduction of a substantial number of inserts 92 and because it further insures that the leading edge of each insert 92 can slide all the way into the deepmost portion of the jacket 40. The inserts 92 are propelled by the conveyors 90, 91 of the secondary feeders 9 which are located downstream of the cam 41 and upstream of the evacuating unit 10. The movement of the second wall 12 back to the fully open position of FIG. 2 entails a pivotal movement of braking members 47 away from the first wall 11 so that the members 47 cannot interfere with entry of inserts 92 into the deepmost portion of the jacket 40. As mentioned above, the springs 49 bias the braking members 47 against the second wall 12 and the members 47 can move close to the first wall 11 only when the second wall 12 is moved from the fully open position, i.e., nearer to the first wall 11.

When the pocket 2 advances beyond the secondary feeders 9, the roller follower 52 on the lever 51 reaches and engages the stationary cam 45 which causes the shaft 21 to pivot the intercepting levers 22 to their retracted positions (i.e., away from the first wall 11) to thus enable the evacuating unit 10 to rapidly remove the fully assembled newspaper 140 (including a jacket 40 and one or more inserts 92 in the jacket) by way of the gap between the lowermost portions of the walls 11 and 12.

When the roller follower 52 engages the cam 45, the roller follower 27 engages a stationary cam 46 which pushes the holder 25 toward the carrier 3 to stress the spring 35 and to reengage the holder with the pallet of the locking pawl 36. Thus, the retaining blade 26 is fully disengaged from the assembled newspaper 140 and is removed from the pocket 2 before the newspaper begins to leave the pocket. When the roller follower 52 advances beyond the cam 45, the intercepting levers 22 return into engagement with or close to the first wall 11 and the pocket 2 is ready to receive a jacket 40 from the primary feeder 8' of the second stuffer. The reference characters 44' and 46' (see FIG. 1) denote cams which correspond to the cams 44 and 46 and are respectively located in the path of movement of successive lobes 37 and roller followers 27 while the pockets 2 travel along that portion of the endless path 1 which is disposed between the evacuating units 10 and 10'.

The means for arresting the holding blade 26 in the position of FIG. 2 (i.e., substantially midway between the intercepting levers 22) is not specifically shown in the drawing. Such means may include a stop in the path of movement of the roller follower 27 or 29, or in the path of movement of the holder 25.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In an apparatus for collating and otherwise manipulating sheet material articles including jackets which exhibit a tendency to open and inserts for such jackets, particularly in a newspaper stuffing apparatus, the combination of a plurality of pockets each having a first and a second wall, said second wall being movable with respect to said first wall between first and second positions and said walls enabling the jacket therein to open in one of said positions of said second wall; means for transporting said pockets along an endless path, said pockets extending transversely of the direction of movement of pockets along said path; at least one stuffer including a first device for feeding jackets between the walls of successive pockets in a first portion of said path and at least one second device for feeding inserts into the jackets in successive pockets in a second portion of said path; means for moving said second walls of successive pockets to said one position intermediate said first and second portions of said path; means for evacuating assembled jackets and inserts from successive pockets in a third portion of said path; at least one retaining device for each of said pockets; guide means for each of said retaining devices, said guide means having a longitudinally extending direction and extending transversely of the direction of movement of pockets along said path; means for introducing said retaining devices between the walls of successive pockets and into open jackets in such pockets intermediate said first and second portions of said path, said introducing means including means for moving said retaining devices in one direction along the respective guide means; means for moving the inserted retaining devices toward one of the respective walls to thereby clamp a portion of the open jacket against said one wall of the respective pocket during transport of pockets past said second feeding device; and means for removing said retaining devices from the respective pockets not later than in said third portion of said path, said removing means including means for moving said retaining devices in the opposite direction along the respective guide means.

2. The combination of claim 1, further comprising means for moving each of said retaining devices away from the respective one wall and from the clamped portion of the jacket in the respective pocket prior to removal of said retaining devices from the respective pockets.

3. The combination of claim 1, wherein said means for moving said second walls comprises a follower associated with each of said second walls and a cam disposed intermediate said first and second portions of said endless path and located in the path of movement of successive followers.

4. The combination of claim 1, wherein each of said guide means comprises an elongated turnable shaft, said retaining devices being movable axially of and being turnable with the respective shafts, said means for moving said retaining devices toward said one wall of the respective pockets including means for turning said retaining devices and the respective shafts.

5. The combination of claim 4, wherein said turning means includes resilient means.

6. The combination of claim 5, further comprising means for shifting each of said retaining devices away from the respective one wall prior to removal of such retaining device from the respective pocket, said shifting means comprising means for turning said shafts against the opposition of said resilient means.

7. The combination of claim 6, wherein said shifting means comprises a follower for each of said shafts and a cam adjacent said path, and further comprising means for maintaining said follower means in engagement with said cam during transport of the respective pockets from said first toward said second feeding device.

8. The combination of claim 7, further comprising means for adjusting said cam to thereby change the extent to which each of said retaining devices is moved away from the one wall of the respective pocket during transport of the corresponding follower along said cam.

9. The combination of claim 1, wherein each of said introducing means comprises resilient means which stores energy in response to removal of the respective retaining device from the associated pocket.

10. The combination of claim 9, further comprising means for releasably locking said retaining devices against movement into the respective pockets during transport of such pockets past said first feeding device.

11. The combination of claim 10, further comprising means for disengaging said locking means during transport of successive pockets from said first toward said second feeding device.

12. The combination of claim 1, wherein said walls of each of said pockets define a gap through which the assembled jackets and inserts are removed by said evacuating means, and further comprising intercepting means for each of said pockets, each of said intercepting means normally extending across the respective gap to prevent the removal of the pockets and inserts from the respective pocket, and means for retracting said intercepting means not later than in said third portion of said path to allow for removal of assembled jackets and inserts by said evacuating means.

13. The combination of claim 12, wherein said retracting means comprises followers operatively connected with said intercepting means and cam means adjacent said third portion of said path, said followers engaging said cam means and to thereby retract the respective intercepting means.

14. The combination of claim 1, wherein said endless path is an oval path and includes elongated first and second stretches which are parallel to each other.

15. The combination of claim 14, wherein said first and second portions of said path respectively form part of said first and second stretches.

16. The combination of claim 1, wherein said walls of each of said pockets include panels which define a compartment on movement of the second wall toward the respective first wall, each of said compartments being in line with the direction of movement of the corresponding retaining device during introduction of such retaining device into the respective pocket.

17. The combination of claim 16, wherein said walls have upper and lower edge portions and said second walls are pivotable about axes adjacent the lower edge portions thereof, said compartments being adjacent the upper edge portions of the respective walls.

18. The combination of claim 17, wherein each of said first walls has a lower panel and an upper panel making an obtuse angle with the respective lower panel, each of said second walls having a lowermost panel, a median panel making with the lowermost panel an obtuse angle which at least approximates said first mentioned obtuse angle, and an uppermost panel which defines said compartment with the upper panel of the respective first wall.

19. The combination of claim 18, wherein said lowermost and uppermost panels of each of said second walls are disposed in parallel planes.

* * * * *